US009336930B2

(12) United States Patent
Motohara

(10) Patent No.: US 9,336,930 B2
(45) Date of Patent: May 10, 2016

(54) COMPOSITE CABLE AND METHOD OF MANUFACTURING COMPOSITE CABLE

(71) Applicant: OLYMPUS CORPORATION, Tokyo (JP)

(72) Inventor: Hiroyuki Motohara, Hachioji (JP)

(73) Assignee: OLYMPUS CORPORATION, Tokyo (JP)

( * ) Notice: Subject to any disclaimer, the term of this patent is extended or adjusted under 35 U.S.C. 154(b) by 323 days.

(21) Appl. No.: 13/709,557

(22) Filed: Dec. 10, 2012

(65) Prior Publication Data

US 2013/0098657 A1 Apr. 25, 2013

Related U.S. Application Data

(63) Continuation of application No. PCT/JP2011/061658, filed on May 20, 2011.

(30) Foreign Application Priority Data

Jun. 11, 2010 (JP) ..... 2010-134216

(51) Int. Cl.
*H01B 11/02* (2006.01)
*H01B 13/02* (2006.01)
*H01R 43/28* (2006.01)

(52) U.S. Cl.
CPC ..... *H01B 11/02* (2013.01); *H01R 43/28* (2013.01); *H01B 13/02* (2013.01)

(58) Field of Classification Search
CPC ..... H01B 11/02; H01B 13/002; H01R 43/28
USPC ..... 174/113 R; 140/111
See application file for complete search history.

(56) References Cited

U.S. PATENT DOCUMENTS 3,921,381 A * 11/1975 Vogelsberg ..... 57/294
4,973,238 A * 11/1990 Kihlken et al. ..... 425/105
6,501,889 B1 * 12/2002 Griffioen et al. ..... 385/114
6,717,058 B2 4/2004 Booth et al.

(Continued)

FOREIGN PATENT DOCUMENTS

CN 1453801 A 11/2003
CN 101707071 A 5/2010

(Continued)

OTHER PUBLICATIONS

International Search Report dated Aug. 9, 2011 issued in PCT/JP2011/061658.

*Primary Examiner* — Timothy Thompson
*Assistant Examiner* — Charles Pizzuto
(74) *Attorney, Agent, or Firm* — Scully, Scott, Murphy & Presser, PC

(57) ABSTRACT

A composite cable that includes plural cables connectable to respective connection portions arranged on a substrate, and an outer coat that covers the cables, the composite cable including: a position fixation portion, in which the cables are fixed in positions so as to be parallel to one another in a longitudinal direction of the cables; and a twist portion, in which the cables extending from an end portion of the position fixation portion are twisted together, wherein in the position fixation portion, an arrangement pattern of the cables on a cross-section perpendicular to the longitudinal direction of the cables is mirror symmetric to an arrangement pattern of the connection portions.

8 Claims, 11 Drawing Sheets

(56) References Cited

U.S. PATENT DOCUMENTS

| | | | | |
|---|---|---|---|---|
| 8,785,782 | B2 * | 7/2014 | Kim et al. | 174/113 C |
| 8,912,445 | B2 * | 12/2014 | Sekido et al. | 174/74 R |
| 2003/0196829 | A1 | 10/2003 | Booth et al. | |

FOREIGN PATENT DOCUMENTS

| | | | | | |
|---|---|---|---|---|---|
| EP | 1172827 | | * | 1/2002 | H01B 7/295 |
| JP | 53-75491 | A | | 7/1978 | |
| JP | 54-164274 | A | | 12/1979 | |
| JP | 55-6710 | A | | 1/1980 | |
| JP | 55-10933 | B2 | | 3/1980 | |
| JP | 56-76122 | A | | 6/1981 | |
| JP | 63-82314 | A | | 5/1988 | |
| JP | 2-018813 | A | | 1/1990 | |
| JP | 5-166416 | A | | 7/1993 | |
| JP | 05166416 | | * | 7/1993 | H01B 7/08 |
| JP | 05166416 | A | * | 7/1993 | H01B 7/08 |
| JP | 2003-331656 | A | | 11/2003 | |
| JP | 2004-192865 | A | | 7/2004 | |
| JP | 2006-190495 | A | | 7/2006 | |

* cited by examiner

COMPOSITE CABLE AND METHOD OF MANUFACTURING COMPOSITE CABLE

CROSS-REFERENCE TO RELATED APPLICATIONS

This application is a continuation of PCT international application Ser. No. PCT/JP2011/061658 filed on May 20, 2011 which designates the United States, incorporated herein by reference, and which claims the benefit of priority from Japanese Patent Application No. 2010-134216, filed on Jun. 11, 2010, incorporated herein by reference.

BACKGROUND OF THE INVENTION

1. Field of the Invention

The present invention relates to a composite cable capable of collectively connecting a plurality of cables and to a method of manufacturing the composite cable.

2. Description of the Related Art

Conventionally, to connect a plurality of electronic devices, a composite cable formed of a plurality of cables bundled together is generally used to connect connection portions of the respective electronic devices to one another. For example, a technology is disclosed in which a composite cable formed of a twist portion with a predetermined length and a non-twist portion with a predetermined length that are alternately arranged at a predetermined pitch is used to improve the reliability against noise of an electronic device (see, for example, Japanese Laid-open Patent Publication No. 2-18813).

SUMMARY OF THE INVENTION

A composite cable according to an aspect of the present invention formed of a plurality of cables connectable to respective connection portions arranged on a substrate, and an outer coat that covers the cables, includes: a position fixation portion, in which the cables are fixed in positions so as to be parallel to one another in a longitudinal direction of the cables; and a twist portion, in which the cables extending from an end portion of the position fixation portion are twisted together, wherein in the position fixation portion, an arrangement pattern of the cables on a cross-section perpendicular to the longitudinal direction of the cables is mirror symmetric to an arrangement pattern of the connection portions.

A method according to another aspect of the present invention of manufacturing a composite cable formed of a plurality of cables connectable to respective connection portions arranged on a substrate, and an outer coat that covers the cables, includes: a position fixing step including fixing an arrangement pattern of the cables on a cross-section perpendicular to a longitudinal direction of the cables so as to be mirror symmetric to an arrangement pattern of the connection portions while fixing the cables so as to be parallel to one another in a longitudinal direction of the cables; and a twisting step including twisting the cables extending from an end portion of the position fixation portion together.

The above and other features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
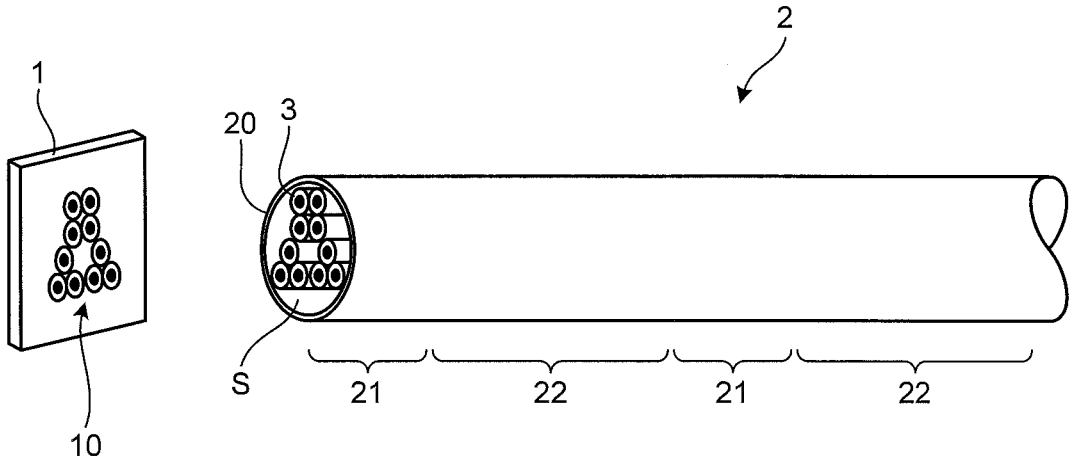
FIG. 1 is a diagram illustrating a composite cable according to an embodiment of the present invention.

Exemplary embodiments of the present invention will be explained in detail below with reference to the accompanying drawings. The present invention is not limited by the embodiments below. Each drawing referred to in the explanation below only schematically illustrates shapes, sizes, and positional relationships such that the content of the present invention can be understood. Therefore, the present invention is not limited to only the shapes, sizes, and positional relationships illustrated in the drawings.

Figure 2:
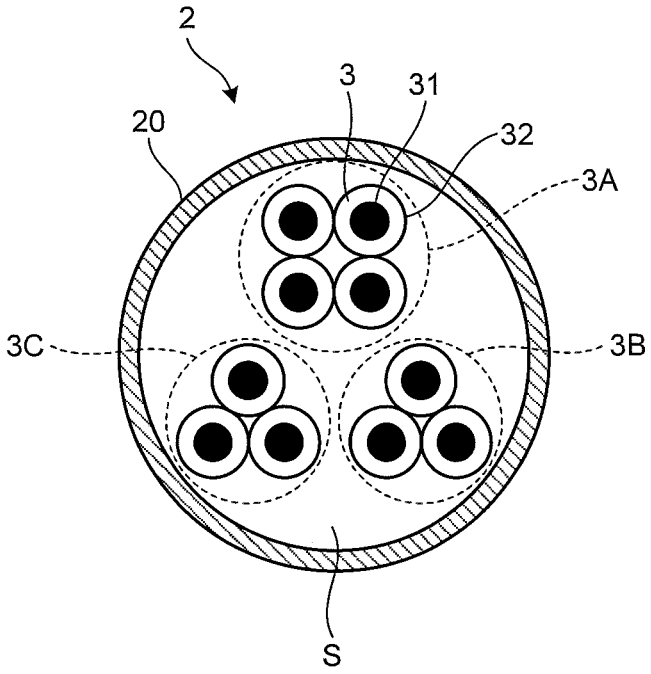
FIG. 2 is a partial cross-sectional view of the composite cable illustrated in FIG. 1.

FIG. 1 is a diagram illustrating a composite cable according to an embodiment of the present invention. FIG. 2 is a partial cross-sectional view of a region that forms a position fixation portion 21, taken at a plane perpendicular to a direction in which a composite cable 2 illustrated in FIG. 1 extends. The composite cable 2 is a bundle of cable groups 3A to 3C each being made up of a plurality of cables 3, and the bundled cable groups 3A to 3C are fixed by an outer shield and an outer coat 20 that is made of resin or the like and that covers the outer shield. In the fixation state, polishing treatment is performed on a connection end face of the composite cable 2 so that connection end faces of the respective cables 3 including connection end portions can be formed on the same plane. By bringing the connection end faces of the cables 3 into contact with an arrangement pattern 10 of a plurality of connection portions formed on a substrate 1, the composite cable 2 and the substrate 1 can be electrically connected. In the embodiment, the composite cable 2 includes, for example, cable groups of ten cables. In the composite cable 2, eight out of the ten cables are used as signal input-output lines, one of the rest cables is used as a power supply line, and the other one of the rest cables is used as a GND line.

The composite cable 2 includes the position fixation portion 21, in which the cables 3 are fixed in positions so as to correspond to respective connection portions of the arrangement pattern 10 and so as to be parallel to one another in the longitudinal directions of the cables 3; and a twist portion 22, which extends from an end portion of the position fixation portion 21 and in which the cables 3 are twisted. Each of the cable groups 3A to 3C made up of a predetermined number of the cables 3 is formed by taking into consideration the influence of electromagnetic noise, such as the same clock frequency.

Each of the cables 3 is a coaxial cable with the same diameter, in which a shield is formed on the outer periphery of a core wire 31 via an inner insulator and an outer insulator 32 is provided on the outer periphery of the shield.

When a cable end face S of the position fixation portion 21 is connected to the substrate 1 on which the arrangement pattern 10 is formed, the composite cable 2 described above enables an electrical connection between the substrate 1 and the other end portion of the composite cable 2. The composite cable 2 and the substrate 1 are joined together via a solder or the like after an image of the arrangement pattern on the cable end face S of the composite cable 2 and an image of the arrangement pattern 10 of the connection portions of the substrate 1 are recognized by using, for example, a dual-view optical system. It may be possible to join the composite cable 2 and the substrate 1 together by sandwiching an anisotropic conductive resin material, such as an ACF, between the composite cable 2 and the substrate 1 and performing thermocompression bonding on the anisotropic conductive resin material.

Figure 3:
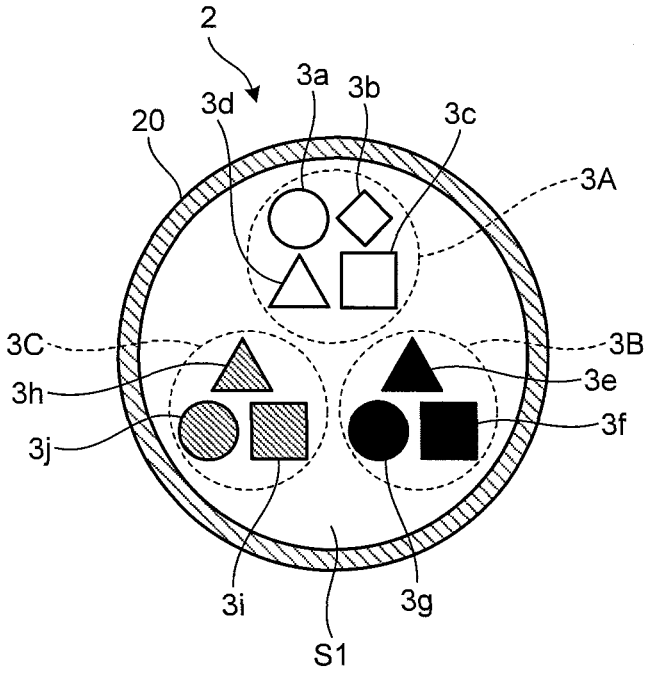
FIG. 3 is a schematic diagram schematically illustrating the composite cable illustrated in FIG. 2.
Figure 4:
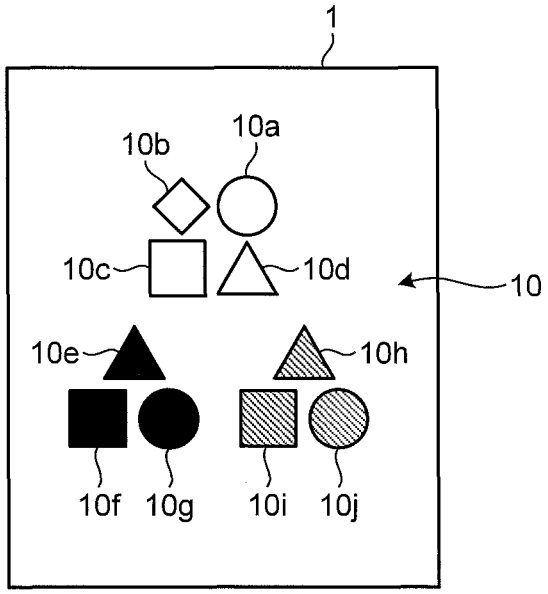
FIG. 4 is a schematic diagram schematically illustrating an arrangement pattern of connection portions of a substrate illustrated in FIG. 1.
Figure 5:
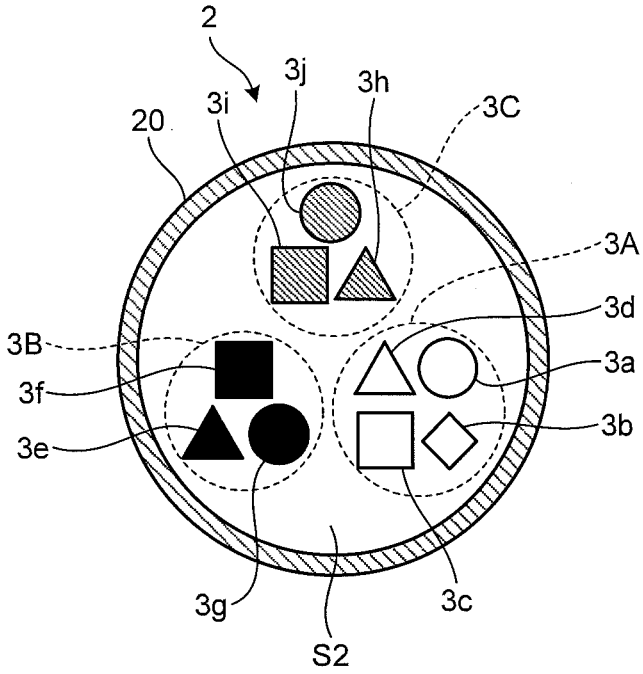
FIG. 5 is a schematic diagram illustrating a cross-section of the composite cable illustrated in FIG. 1.
Figure 6:
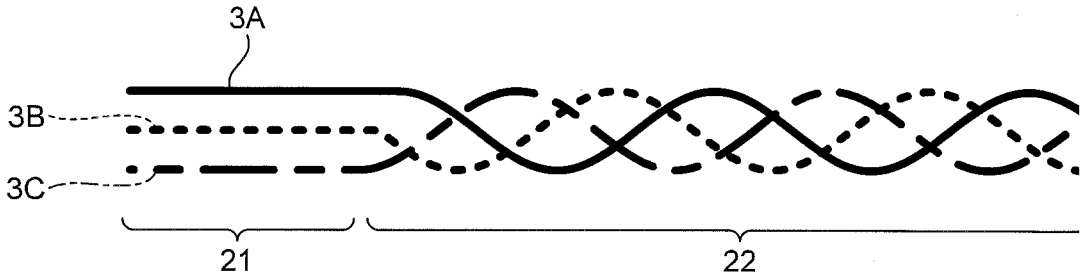
FIG. 6 is a schematic diagram illustrating cable groups of the composite cable according to the embodiment of the present invention.

The arrangement pattern of the cables 3 of the composite cable 2 and the arrangement pattern 10 of the substrate 1 will be explained below with reference to schematic diagrams illustrated in FIGS. 3 to 6. FIG. 3 is a schematic diagram schematically illustrating the composite cable 2 illustrated in FIG. 2. FIG. 4 is a schematic diagram schematically illustrating the arrangement pattern 10 of the connection portions of the substrate 1. FIG. 5 is a schematic diagram illustrating a cross-section of a region forming the twist portion 22, taken at a plane perpendicular to the direction in which the composite cable 2 illustrated in FIG. 1 extends. FIG. 6 is a schematic diagram illustrating the cable groups 3A to 3C of the composite cable 2. In the schematic diagrams illustrated in FIGS. 3 and 5, it is assumed that the vertical direction of the composite cable 2 with respect to the cross-section matches the vertical direction of the sheets of drawings.

On a cable end face S1 of the position fixation portion 21 of the composite cable 2 illustrated in FIG. 3 (a cross-section perpendicular to the longitudinal direction of the composite cable 2), cables 3*a* to 3*j* are fixed in positions so as to be mirror symmetric to the arrangement pattern 10 (see FIG. 4) of connection portions 10*a* to 10*j* to be connected to the cables 3*a* to 3*j*, respectively. Besides, the cables 3*a* to 3*d*, 3*e* to 3*g*, and 3*h* to 3*j* are grouped into the cable groups 3A to 3C, respectively, so that the influence of electromagnetic noise can be prevented. As illustrated in FIG. 6, the cable groups 3A to 3C are fixed in positions and extended so as to be parallel to one another in the longitudinal direction of the composite cable 2.

In this way, the arrangement pattern 10 of the connection portions 10*a* to 10*j* on the substrate 1 and the arrangement pattern of the cables 3*a* to 3*j* are fixed such that their positions on opposing planes become mirror symmetric to each other. Therefore, when the composite cable 2 is connected to a mounting substrate, it is possible to easily and reliably connect wires without causing false arrangement of the wires.

In the twist portion 22, as illustrated in FIGS. 5 and 6, the cable groups 3A to 3C are twisted and crossed together. As will be described later, the cables 3*a* to 3*j* are twisted and crossed together in each of the cable groups 3A to 3C. The positional relationship of the cables 3*a* to 3*j* on a cable end face S2 illustrated in FIG. 5 differs from the arrangement pattern 10 because of the twisting. The twist portion 22 improves the flexural strength of the composite cable 2 due to the twisting of the cable groups 3A to 3C.

The twist portion 22 is formed so as to be longer than the longitudinal length of the position fixation portion 21. This is done in order to increase the flexural strength due to the twisting as much as possible. In the embodiment, it is sufficient that the length of the position fixation portion 21 is long enough to perform end-surface treatment to enable a connection to the substrate, and the length is set to, for example, a few millimeters or shorter. Furthermore, it is sufficient that the length of the twist portion 22 is as long as or longer than a distance (a connection distance) between devices connected by the composite cable 2, and the length is set to, for example, the range from a few centimeters to a few meters.

Figure 7:
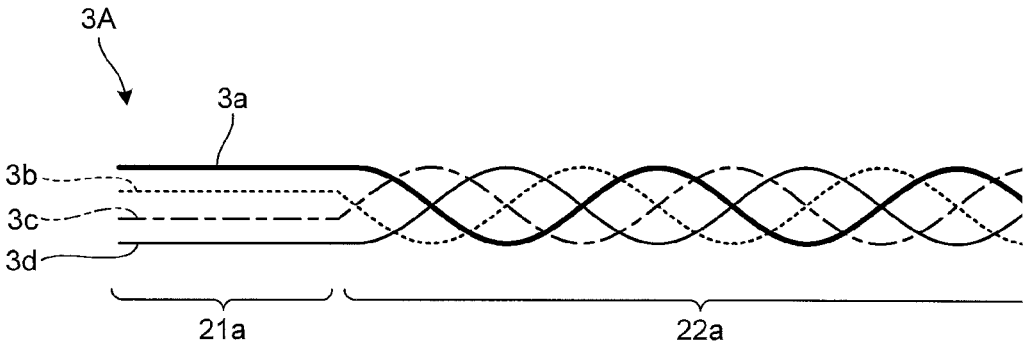
FIG. 7 is a schematic diagram illustrating a cable group of the composite cable according to the embodiment of the present invention.
Figure 8:
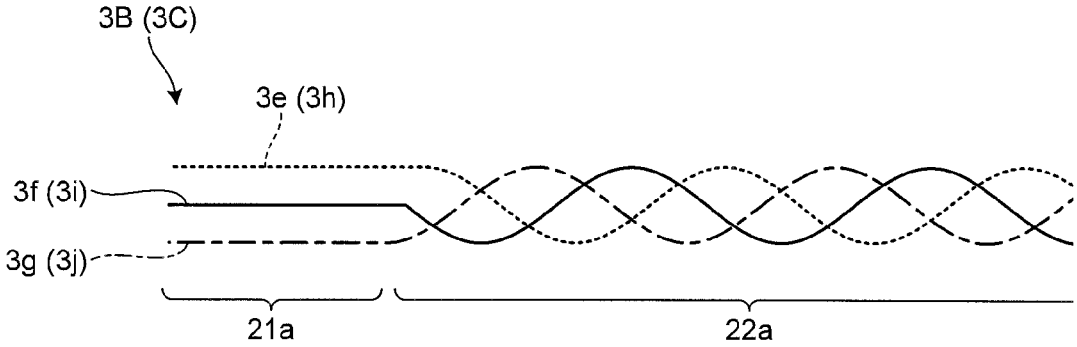
FIG. 8 is a schematic diagram illustrating a cable group of the composite cable according to the embodiment of the present invention.

Each of the cable groups 3A to 3C will be explained below with reference to FIGS. 7 and 8. FIG. 7 is a schematic diagram illustrating the cable group 3A of the composite cable according to the embodiment. FIG. 8 is a schematic diagram illustrating the cable group 3B (3C) of the composite cable according to the embodiment.

In the cable group 3A, as illustrated in FIG. 7, the cables 3*a* to 3*d* are fixed so as to be parallel to one another in the longitudinal direction of the composite cable 2 to correspond to a position fixation portion 21*a*, and the four cables 3*a* to 3*d* are twisted together to correspond to a twist portion 22*a*.

In the cable group 3B (3C), as illustrated in FIG. 8, the cables 3*e* to 3*g* (3*h* to 3*j*) are fixed so as to be parallel to one another in the longitudinal direction of the composite cable 2 to correspond to the position fixation portion 21*a*, and the three cables 3*e* to 3*g* (3*h* to 3*j*) are twisted together to correspond to the twist portion 22*a*.

Figure 9:
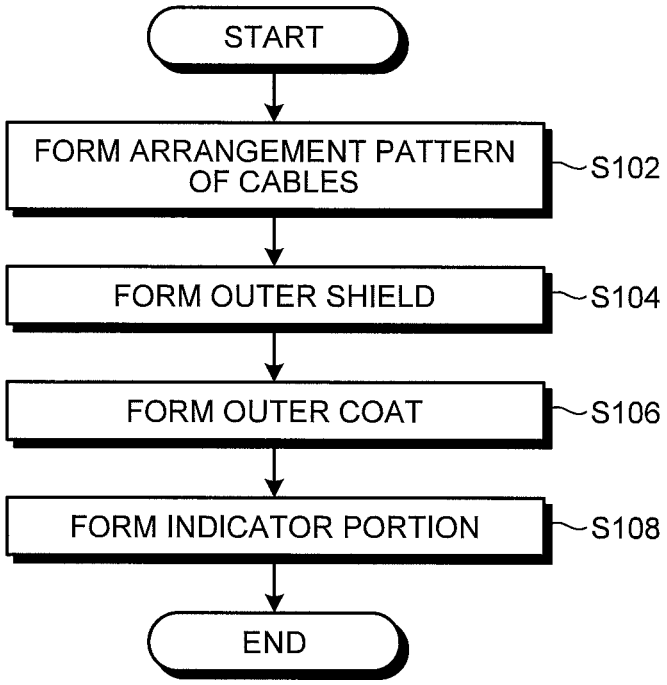
FIG. 9 is a flowchart illustrating an overview of a process in a method of manufacturing the composite cable according to the embodiment of the present invention.

A method of manufacturing the composite cable 2 will be explained below with reference to FIGS. 9 to 13. FIG. 9 is a flowchart illustrating an overview of the method of manufacturing the composite cable according to the embodiment of the present invention. To manufacture the composite cable 2, an arrangement pattern of the cables 3*a* to 3*j* is first formed with respect to the cables 3*a* to 3*j* that are sequentially fed (Step S102). Specifically, in a process of forming the arrangement pattern, the position fixation portion 21 and the twist portion 22 are alternately formed by using the cables 3*a* to 3*j*.

Figure 10:
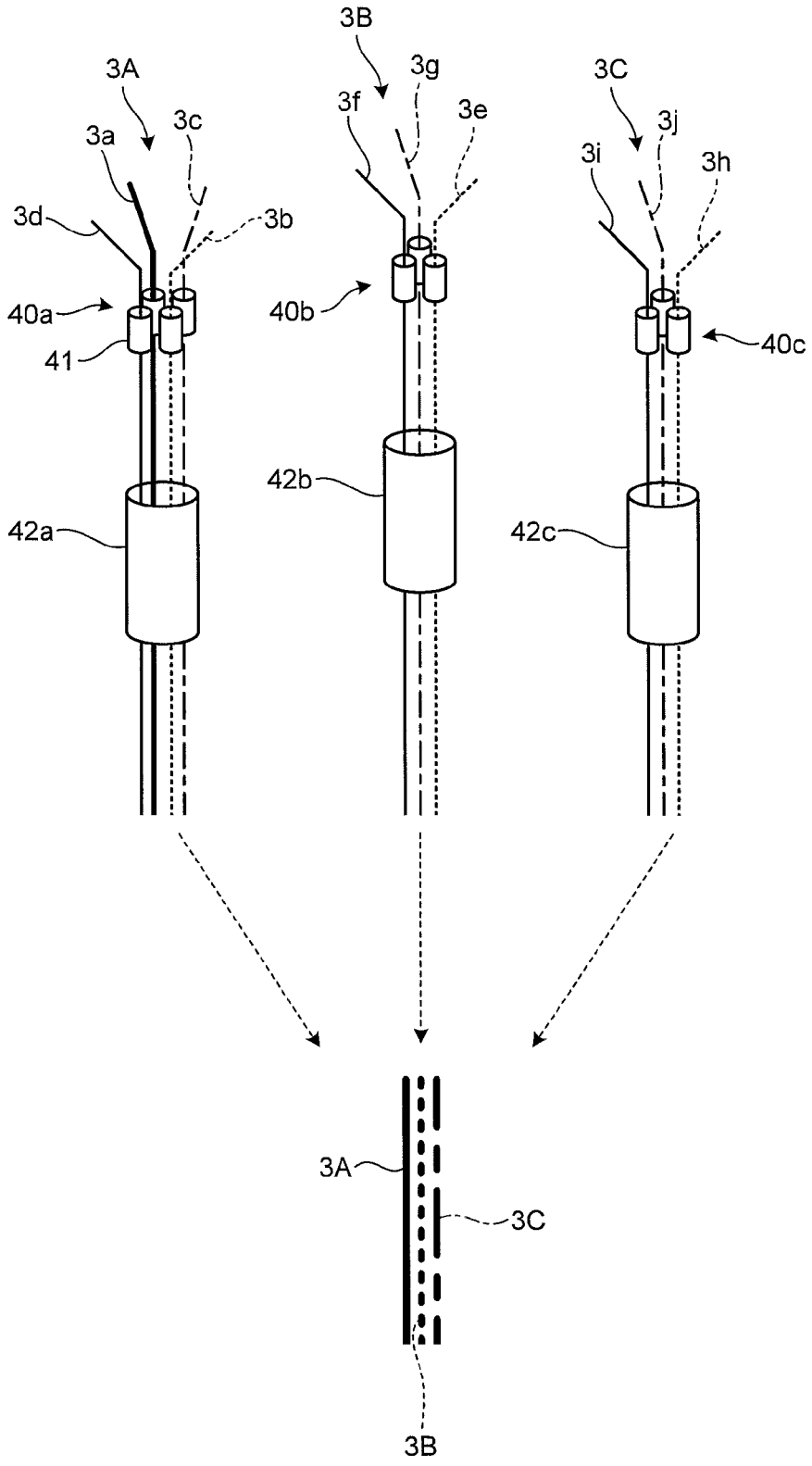
FIG. 10 is a schematic diagram illustrating the method of manufacturing the composite cable according to the embodiment of the present invention.

FIG. 10 is a schematic diagram illustrating a structure of a main part of an arrangement pattern forming apparatus that is used in the process of forming the arrangement pattern and an overview of a process of forming the position fixation portion 21. As illustrated in FIG. 10, the arrangement pattern forming apparatus includes ten rotators 41 in which the cables 3*a* to 3*j* are inserted and held. The cables 3*a* to 3*j* are inserted into the respective rotators 41 so as to be parallel to one another, and the rotators 41 are arranged at the same positions in the longitudinal directions of the cables 3*a* to 3*j*. The four rotators 41, in which the four cables 3*a* to 3*d* are respectively inserted, form a rotator group 40*a*. An arrangement pattern of cable insertion portions of the four rotators 41 of the rotator group 40*a* is the same as the arrangement pattern of the cables on the cross-section perpendicular to the longitudinal direction of the cable group 3A. The three rotators 41, in which the three cables 3*e* to 3*g* are respectively inserted, form a rotator group 40*b*. An arrangement pattern of cable insertion portions of the three rotators 41 of the rotator group 40*b* is the same as the arrangement pattern of the cables on the cross-section perpendicular to the longitudinal direction of the cable group 3B. The three rotators 41, in which the three cables 3*h* to 3*j* are respectively inserted, form a rotator group 40*c*. An arrangement pattern of cable insertion portions of the three rotators 41 of the rotator group 40*c* is the same as the arrangement pattern of the cables on the cross-section perpendicular to the longitudinal direction of the cable group 3C.

On the downstream side of the rotator group 40*a* in the longitudinal direction (lower side in FIG. 10), a rotator 42*a* is arranged to insert and hold the cable group 3A formed by the rotator group 40*a*. On the downstream side of the rotator group 40*b* in the longitudinal direction, a rotator 42*b* is arranged to insert and hold the cable group 3B formed by the rotator group 40*b*. On the downstream side of the rotator group 40*c* in the longitudinal direction, a rotator 42*c* is arranged to insert and hold the cable group 3C formed by the rotator group 40*c*.

The longitudinal central axes of the rotator group 40*a* and the rotator 42*a* always match each other, and the rotator group 40*a* is rotatable about the central axes. The longitudinal central axes of the rotator group 40*b* and the rotator 42*b* always match each other, and the rotator group 40*b* is rotatable about the central axes. The longitudinal central axes of the rotator group 40*c* and the rotator 42*c* always match each other, and the rotator group 40*c* is rotatable about the central axes. The rotation directions of the rotator groups 40*a* to 40*c* are the same.

The longitudinal central axes of the rotator group 40*a* and the rotator 42*a*, the longitudinal central axes of the rotator group 40*b* and the rotator 42*b*, and the longitudinal central axes of the rotator group 40*c* and the rotator 42*c* are parallel to one another and pass through the same circumference on the plane perpendicular to each of the longitudinal directions. The rotator groups 40*a* to 40*c* and the rotators 42*a* to 42*c* are rotatable about an axis that passes through the center of the above-mentioned circumference and that is parallel to the longitudinal directions. Hereinafter, this rotation is referred to as revolution. The revolution direction is the same as the rotation direction of the rotator groups 40*a* to 40*c* described above.

The rotation of the rotator groups 40*a* to 40*c* and the revolution of the rotator groups 40*a* to 40*c* and the rotators 42*a* to 42*c* as described above can be realized by appropriately using a plurality of motors.

The arrangement pattern forming apparatus includes a feeding mechanism (not illustrated) that feeds the cables 3*a* to 3*j* from the upstream side in the longitudinal direction (upper side in FIG. 10) to the downstream side in the longitudinal direction (lower side in FIG. 10).

A process of forming the position fixation portion 21 by using the arrangement pattern forming apparatus configured as above will be explained below. To form the position fixation portion 21, the rotators 41 and 42*a* to 42*c* are stand still, and the feeding mechanism feeds the cables 3*a* to 3*j* from the upstream side to the downstream side in the longitudinal direction so that the cables are inserted into the corresponding rotators 41 and the rotators 42*a* to 42*c*. Thereafter, while the rotator groups 40*a* to 40*c* and the rotators 42*a* to 42*c* are kept stand still, the feeding mechanism feeds the cables 3*a* to 3*j* from the upstream side to the downstream side in the longitudinal direction by a predetermined length. Consequently, the position fixation portion 21 is formed.

Figure 11:
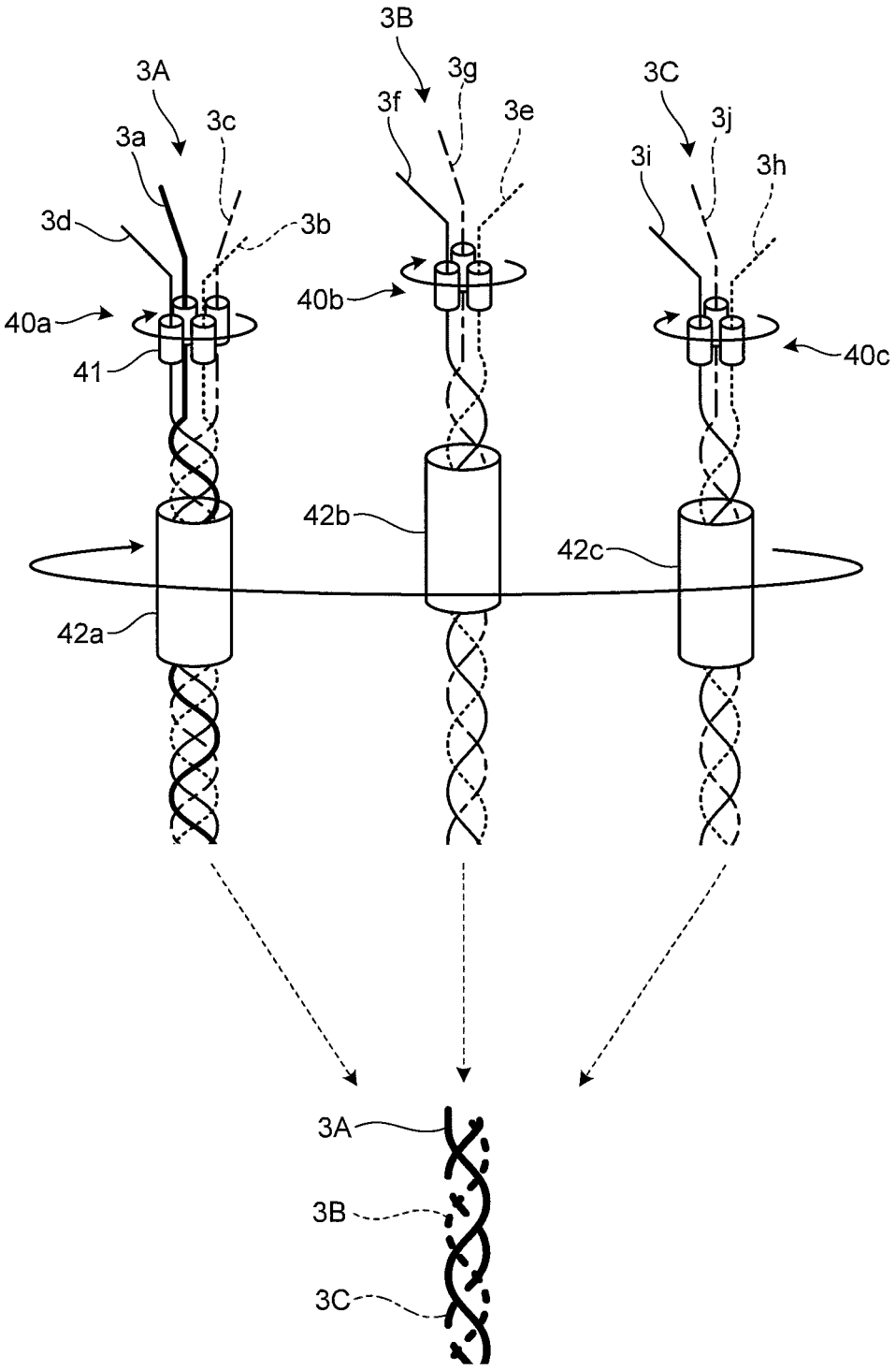
FIG. 11 is a schematic diagram illustrating the method of manufacturing the composite cable according to the embodiment of the present invention.

FIG. 11 is a schematic diagram illustrating an overview of a process of forming the twist portion 22. To form the twist portion 22, the rotators 41 and 42*a* to 42*c* are stand still, and the feeding mechanism feeds the cables 3*a* to 3*j* from the upstream side to the downstream side in the longitudinal direction so that the cables are inserted into the corresponding rotators 41 and the rotators 42*a* to 42*c*. Thereafter, while the rotator groups 40*a* to 40*c* are rotated and the rotator groups 40*a* to 40*c* and the rotators 42*a* to 42*c* are revolved, the feeding mechanism feeds the cables 3*a* to 3*j* from the upstream side to the downstream side in the longitudinal direction by a predetermined length. Consequently, the cables 3*a* to 3*j* are twisted together in each of the cable groups 3A to 3C to form the twist portion 22*a*, and the cable groups 3A to 3C with the twisted cables are further twisted together to form the twist portion 22.

By alternately repeating the process of forming the position fixation portion 21 and the process of forming the twist portion 22 as described above, it is possible to alternately and sequentially form a plurality of the position fixation portions 21 and a plurality of the twist portions 22. The lengths of the position fixation portion 21 and the twist portion 22 can be changed appropriately by controlling the speed or time to feed the cables 3*a* to 3*j*.

When the position fixation portion 21 is formed, it is possible to confirm stop positions of the rotator groups 40*a* to 40*c* and the rotators 42*a* to 42*c* by using a detecting means, such as a position sensor or a rotation sensor. For example, it may be possible to confirm the stop positions of the rotator groups 40*a* to 40*c* and the rotators 42*a* to 42*c* by detecting rotation of a motor. Alternatively, it may be possible to form the rotator groups 40*a* to 40*c* and the rotators 42*a* to 42*c* in different shapes and colors and confirm the stop positions of the rotator groups 40*a* to 40*c* and the rotators 42*a* to 42*c* by image recognition. With the use of the detecting means, it is possible to more accurately maintain the relative positions of cables.

Furthermore, the cables for forming the position fixation portion 21 and the twist portion 22 may be fed at the same speed or at the different speeds.

Figure 12:
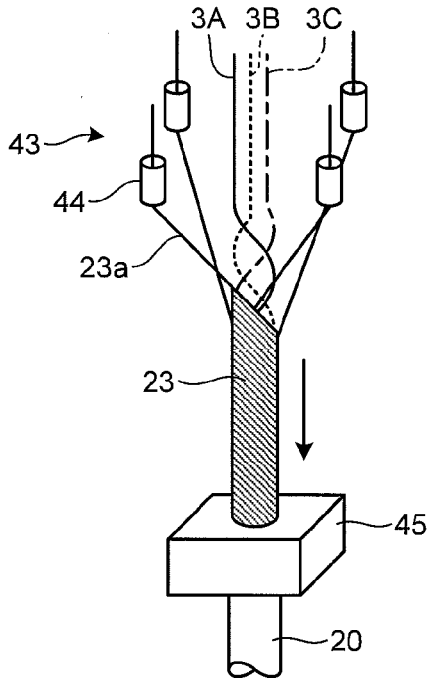
FIG. 12 is a schematic diagram illustrating the method of manufacturing the composite cable according to the embodiment of the present invention.

After the arrangement pattern of the cables 3*a* to 3*j* is formed at Step S102, formation of the outer shield (Step S104) and formation of the outer coat 20 (Step S106) are sequentially performed. FIG. 12 is a schematic diagram illustrating an overview of a process of forming an outer shield 23 and the outer coat 20. As illustrated in FIG. 12, the twisted cable groups 3A to 3C are sequentially fed downward in the drawing, and shields 23*a* are wound around the outer peripheral surfaces of the twisted cable groups 3A to 3C by each of rotators 44 of a rotator group 43, so that the net-like outer shield 23 is formed.

Thereafter, the outer coat 20 is formed on the cable groups 3A to 3C on which the outer shield 23 is formed. The cable groups 3A to 3C on which the outer shield 23 is formed are fed to a furnace 45. The furnace 45 contains an insulating resin material in a dissolved state and the insulating resin material is applied to the outer surface of the outer shield 23. The insulating resin material that has passed through the furnace 45 is solidified by the atmosphere on the outside and covers the outer shield 23 to thereby serve as the outer coat 20.

Figure 13:
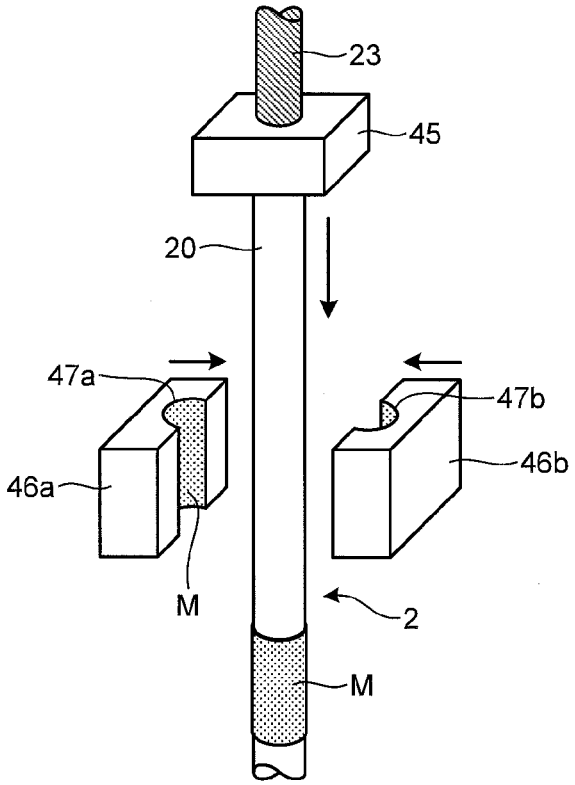
FIG. 13 is a schematic diagram illustrating the method of manufacturing the composite cable according to the embodiment of the present invention.

After the outer coat 20 is formed, an indicator portion is formed at a predetermined position on the outer coat 20 (Step S108). FIG. 13 is a schematic diagram illustrating a method of forming the indicator portion. As illustrated in FIG. 13, the composite cable 2 is sequentially fed downward in the drawing and a paint M is applied as an indicator portion at a position corresponding to the position fixation portion 21 on the composite cable 2. On the outer coat 20 of the composite cable 2, stamps 46*a* and 46*b* are pressed against the composite cable 2 so that the paint M put on recesses 47*a* and 47*b* are transferred onto the outer coat 20 at the position corresponding to the position fixation portion 21. The recesses 47*a* and 47*b* are formed in the arc shape corresponding to the surface of the outer coat 20.

According to the embodiment described above, a position fixation portion, in which the arrangement pattern on the cross-section perpendicular to the longitudinal direction is fixed to be mirror symmetric to the arrangement pattern of the substrate, and a twist portion, in which the cable groups and the cables are twisted, are provided. Therefore, when the end face is connected to the substrate, it is possible to connect them without interposing an auxiliary member between the end face and the substrate, and it is possible to ensure the flexural property of the composite cable by the twist portion. Furthermore, the length of the composite cable is adjustable by providing a plurality of the position fixation portions. In this case, it is possible to easily adjust the length by cutting a region coated with the paint M.

Figure 14:
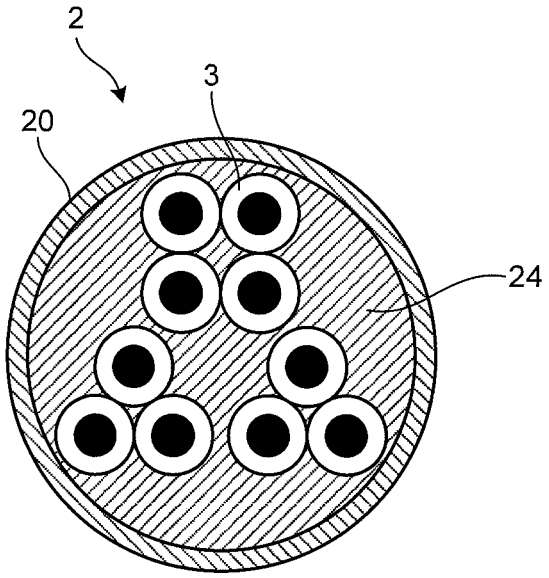
FIG. 14 is a schematic diagram illustrating a composite cable according to a first modification of the embodiment of the present invention.

It may be possible to fill a gap between the outer coat 20 and each of the cables 3 with a fixing member or the like on the cable end face S (S1) of the position fixation portion 21 illustrated in FIG. 1. As in a first modification illustrated in FIG. 14, if a gap between the outer coat 20 and each of the cables 3 is filled with a fixing member 24, it becomes possible to further fix the positions of the cables, enabling to prevent positional deviation of the cables. As a result, it is possible to improve the connectivity of the composite cable 2 with the substrate 1.

Figure 15:
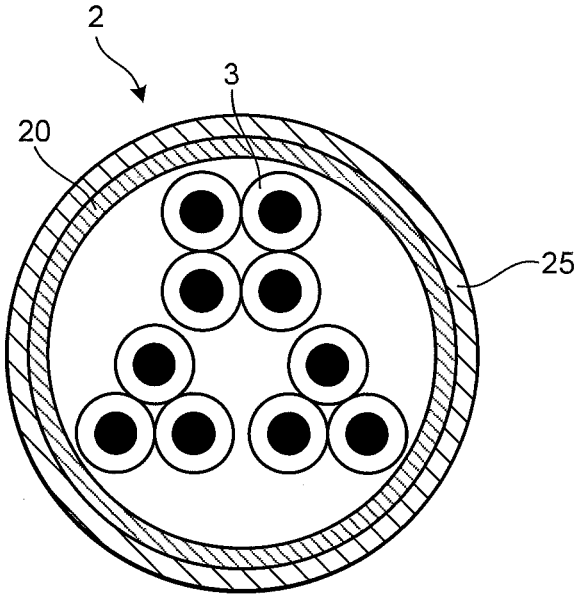
FIG. 15 is a schematic diagram illustrating a composite cable according to a second modification of the embodiment of the present invention.

FIG. 15 illustrates a schematic diagram of a composite cable according to a second modification of the embodiment of the present invention. As in the second modification illustrated in FIG. 15, it is possible to fix the outer periphery of the outer coat 20 of the position fixation portion 21 with a fixing member 25. Because the outer coat 20 is cured by the fixing member 25, it is possible to improve the effect to fix the positions of the cables when a force is applied from the outside.

The fixing members 24 and 25 described above are realized by an adhesive agent, such as a thermosetting resin or an ultraviolet curable resin, and at least an end face of the position fixation portion 21 to be connected to the substrate 1 is fixed. Furthermore, the fixing member 24 may be applied to the gap between the outer coat 20 and each of the cables 3 in a portion corresponding to the position fixation portion 21 after the cables 3 are cut, or may be applied when the outer shield 23 illustrated in FIG. 12 is formed. When the fixing member 24 is applied after the cables 3 are cut, it is more preferable that the outer coat 20 is fixed by the fixing member 25. It may also be possible to fix the composite cable 2 by using both of the fixing members 24 and 25. It may also be possible to perform plating processing on the cable end face S for protection after the fixing members 24 and/or 25 are filled or applied in order to prevent corrosion or the like of the cable end face.

Figure 16:
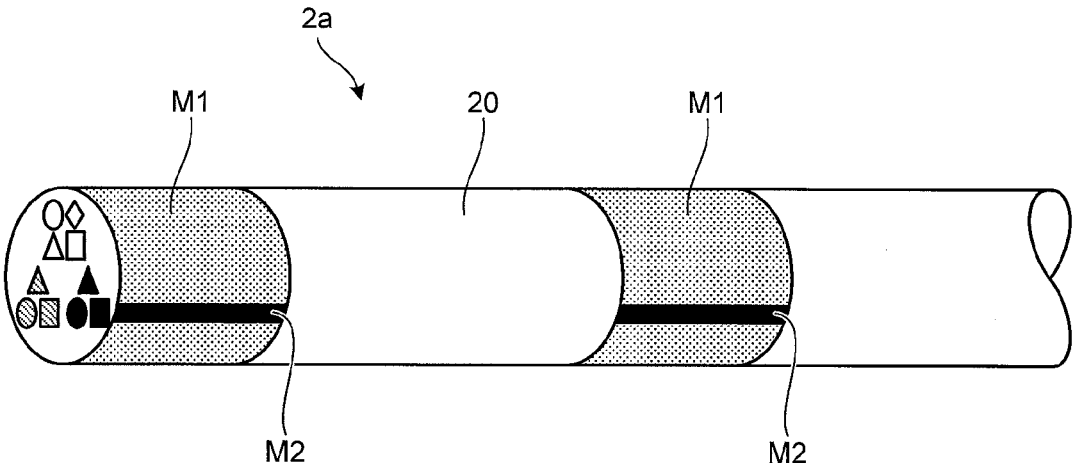
FIG. 16 is a schematic diagram illustrating a composite cable according to a third modification of the embodiment of the present invention.

FIG. 16 is a schematic diagram illustrating a composite cable 2*a* according to a third modification of the embodiment of the present invention. In the composite cable 2*a* illustrated in FIG. 16, paints M1 and M2 are applied to the outer coat 20 as indicator portions indicating position fixation portions. The paints M1 and M2 are formed with different materials and/or different colors. In particular, the paint M2 in a linear shape along the longitudinal direction of the composite cable 2*a* is applied at a predetermined position so that the position of a predetermined cable can be recognized and so that the effect to determine the position of the composite cable with respect to the substrate can be obtained at the time of connection. The indicator portions may be realized by a concave-convex shape rather than the paint.

Figure 17:
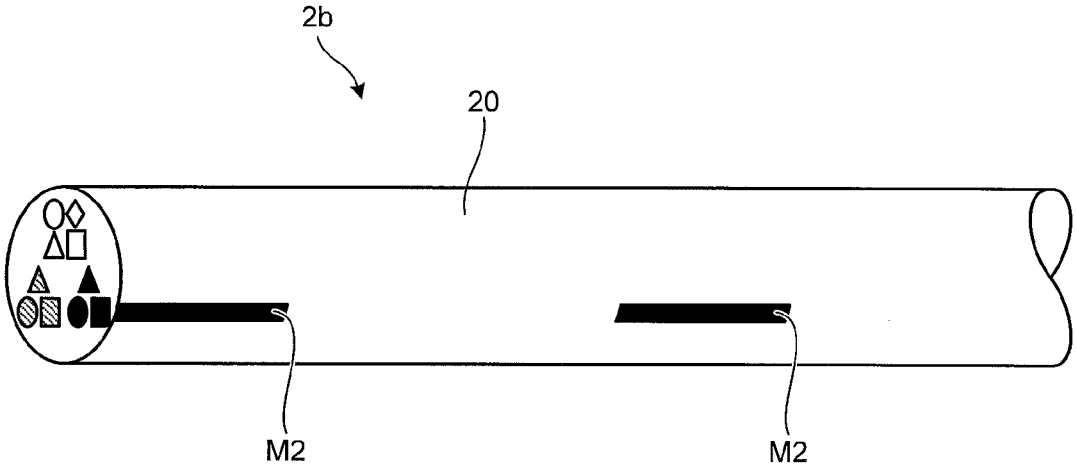
FIG. 17 is a schematic diagram illustrating a composite cable according to a fourth modification of the embodiment of the present invention.
Figure 18:
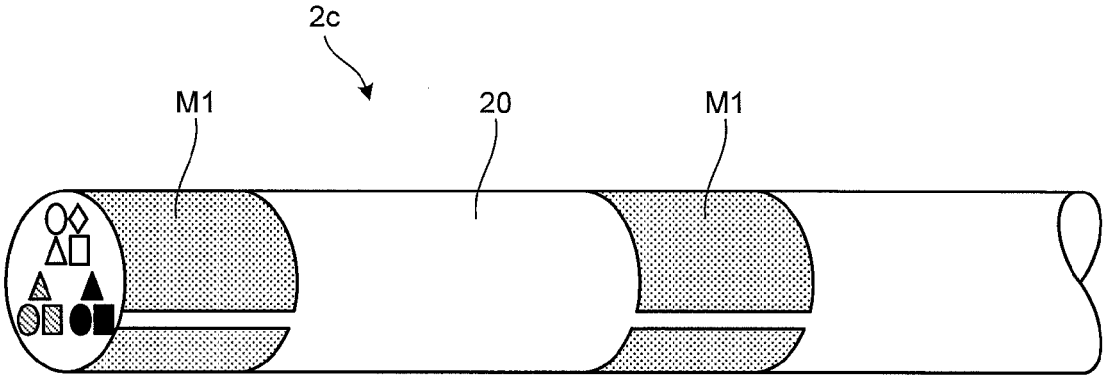
FIG. 18 is a schematic diagram illustrating a composite cable according to a fifth modification of the embodiment of the present invention.

As in a fourth modification illustrated in FIG. 17, it is possible to apply only the paint M2, as the indicator portion, to the outer coat 20 of a composite cable 2*b*. Of course, as illustrated in a fifth modification illustrated in FIG. 18, it is possible to apply only the paint M1, as the indicator portion, to the outer coat 20 of a composite cable 2*c*. According to the fourth and the fifth modifications described above, it is possible to achieve the same advantageous effects as those of the first modification and it is also possible to reduce costs for the paint and the operating process for application of the paint because only one of the paints is used.

Figure 19:
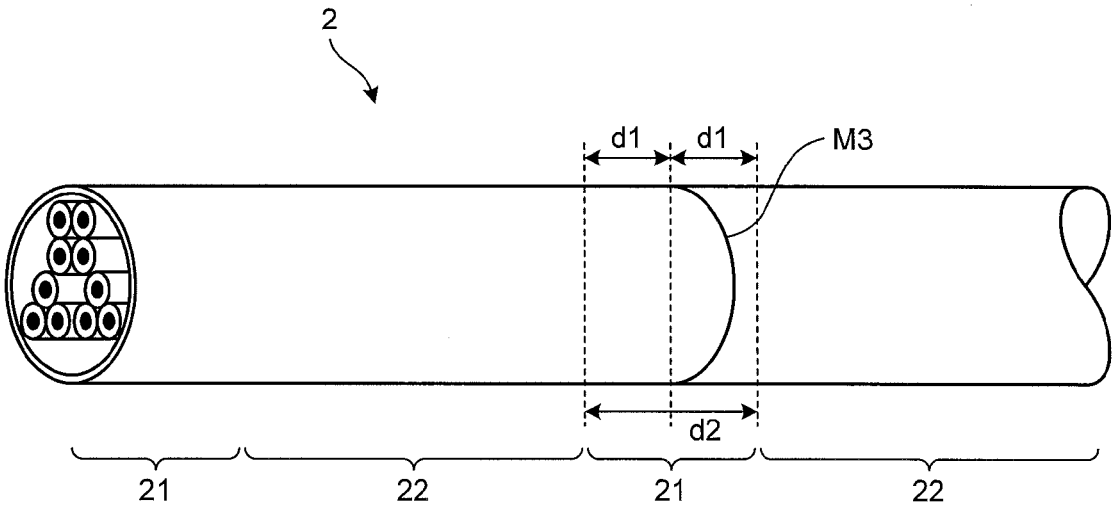
FIG. 19 is a diagram illustrating the composite cable according to the embodiment of the present invention.

Regarding a region where the position fixation portion 21 is formed, it is preferable that at least the length of the region in the longitudinal direction of the composite cable is equal to or longer than d1 that is the length needed to connect to the substrate. In particular, as illustrated in FIG. 19, it is preferable that the length of the position fixation portion 21 is d2 that is twice the length d1. When the length is d2, if a portion with the length d1 from the end portion of the position fixation portion 21 is cut, the length of each of the cut end portions of the position fixation portion 21 becomes d1. Therefore, both of the cut end portions can be connected to the substrate. In this case, it may be possible to apply paint M3 in a linear shape as an indicator portion for indicating a portion to be cut.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A composite cable that includes a plurality of cables connectable to respective connection portions arranged on a substrate, and an outer coat that covers the cables, the composite cable comprising:

a position fixation portion, in which a gap between each of the cables and the outer coat is fixed by a fixing member so as to prevent positional deviation of each of the cables relative to the outer coat such that the cables are fixed in positions so as to be parallel to one another in a longitudinal direction of the cables; and a twist portion, in which the cables extending from an end portion of the position fixation portion are twisted together, wherein in the position fixation portion, an arrangement pattern of the cables on a cross-section perpendicular to the longitudinal direction of the cables is mirror symmetric to an arrangement pattern of the connection portions.

2. The composite cable according to claim 1, wherein a length of the position fixation portion is shorter than a length of the twist portion.

3. The composite cable according to claim 1, wherein the outer coat includes an indicator portion indicating the position fixation portion on at least a portion of a surface of the position fixation portion.

4. The composite cable according to claim 1, wherein the composite cable comprises a plurality of cable groups, each being formed of some of the cables, and in the twist portion, the cables of each of the cable groups are twisted together and the cable groups are also twisted together.

5. The composite cable according to claim 1, wherein the cross-sectional shape of the position fixation portion in a plane perpendicular to the longitudinal direction is circular.

6. The composite cable according to claim 5, wherein the cross-sectional shape the twist portion in the plane perpendicular to the longitudinal direction is circular.

7. The composite cable according to claim 1, wherein the fixing member is a first fixing member, the composite cable further comprising a second fixing member disposed on an outer periphery of the outer coat at least in the position fixation portion.

8. A method of manufacturing a composite cable that includes a plurality of cables, a connection end portion of each of the cables being connectable to respective connection portions arranged on a substrate, and an outer coat that covers the cables, the method comprising:

a position fixing step including fixing an arrangement pattern of the cables on a cross-section perpendicular to a longitudinal direction of the cables so as to be mirror symmetric to an arrangement pattern of the connection portions while fixing the cables so as to be parallel to one another in a longitudinal direction of the cables by a fixing member that fixes a gap between each of the cables and the outer coat;

a twisting step including twisting the cables extending from an end portion of the position fixation portion together; and a polishing step of performing polishing treatment on a connection end face of the composite cable in a state that the cables are fixed so as to form connection end faces of the cables including the connection end portions on a same plane.

* * * * *